US007762548B2

(12) United States Patent
Suzuki et al.

(10) Patent No.: US 7,762,548 B2
(45) Date of Patent: Jul. 27, 2010

(54) CONVEYANCE APPARATUS, CONTROL METHOD THEREFOR, AND PRINTING APPARATUS

(75) Inventors: Yuichiro Suzuki, Yokohama (JP); Hiroyuki Saito, Yokohama (JP); Kentaro Onuma, Yokohama (JP); Hiroyuki Kakishima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/543,837

(22) Filed: Aug. 19, 2009

(65) Prior Publication Data

US 2009/0302532 A1 Dec. 10, 2009

Related U.S. Application Data

(63) Continuation of application No. 11/831,114, filed on Jul. 31, 2007, now Pat. No. 7,597,322.

(30) Foreign Application Priority Data

Aug. 23, 2006 (JP) ..... 2006-226700

(51) Int. Cl.
*B65H 7/02* (2006.01)

(52) U.S. Cl. ..... 271/265.02; 347/101; 700/213; 271/264

(58) Field of Classification Search ..... 271/264, 271/272, 265.01, 265.02; 700/213; 341/101
See application file for complete search history.

(56) References Cited

U.S. PATENT DOCUMENTS 7,290,763 B2 11/2007 Suzukiu et al. ..... 271/9.13
7,401,913 B2 * 7/2008 Nishiberi et al. ..... 347/104
7,415,239 B2 * 8/2008 Saito et al. ..... 399/388
7,597,322 B2 * 10/2009 Suzuki et al. ..... 271/265.02
2004/0183846 A1 9/2004 Kunihiro ..... 347/14
2007/0007711 A1 1/2007 Suzuki et al. ..... 271/121
2007/0031175 A1 * 2/2007 Takeda et al. ..... 400/636
2008/0006994 A1 * 1/2008 Otani et al. ..... 271/264
2008/0049089 A1 2/2008 Ishikawa et al.
2008/0050164 A1 2/2008 Yanagi et al.
2008/0050165 A1 2/2008 Saito et al.
2009/0066018 A1 * 3/2009 Iesaki et al. ..... 271/272

FOREIGN PATENT DOCUMENTS

JP 2004-127182 8/2004
JP 2004-230817 8/2004

* cited by examiner

*Primary Examiner*—Kaitlin S Joerger
(74) *Attorney, Agent, or Firm*—Fitzpatrick, Cella, Harper & Scinto

(57) ABSTRACT

A conveyance apparatus increases the conveyance precision of a conveyance unit. The conveyance apparatus has first and second conveyance rollers. The conveyance apparatus includes a DC motor serving as a driving source for the conveyance rollers, a first encoder which outputs a first pulse signal in accordance with rotation of the first conveyance roller, a second encoder which outputs a second pulse signal in accordance with rotation of the second conveyance roller, and a control unit having a first mode in which the DC motor is controlled based on first information about the first pulse signal when executing a conveyance operation to convey a sheet by using the first and second conveyance rollers, and a second mode in which the DC motor is controlled based on second information about the second pulse signal when executing a conveyance operation to convey a sheet by using the second conveyance roller.

5 Claims, 14 Drawing Sheets

CONVEYANCE APPARATUS, CONTROL METHOD THEREFOR, AND PRINTING APPARATUS

This application is a continuation of U.S. patent application Ser. No. 11/831,114, filed Jul. 31, 2007, allowed May 19, 2009.

BACKGROUND OF THE INVENTION

1. Field of the Invention

The present invention relates to a conveyance apparatus which conveys a sheet using, for example, two conveyance units equipped with encoders, a control method therefor, and a printing apparatus.

2. Description of the Related Art

For example, an inkjet printing apparatus comprises an LF roller and discharge roller as a mechanism for conveying a sheet. When conveying a sheet, the inkjet printing apparatus uses the LF roller as a main conveyance unit, and the discharge roller as an auxiliary unit.

In the positional relationship between these two rollers, an area where the printhead scans is defined as that between the LF roller arranged on the upstream side and the discharge roller arranged on the downstream side. Hence, the print area is an area corresponding to a printhead scan area defined when the LF roller and discharge roller hold print paper.

The print area is also an area corresponding to a printhead scan area defined when only the discharge roller conveys print paper. That is, the inkjet printing apparatus prints even in an area at the trailing end of print paper.

When printing in the trailing end area, the number of nozzles for use in the printhead is decreased to reduce the amount of conveyance by one conveyance operation in order to compensate for a drop in conveyance precision (Japanese Patent Laid-open No. 2004-230817).

However, this arrangement decreases the amount of conveyance by one conveyance operation. This increases the number of printhead scan operations and the number of conveyance operations, and lowers the throughput.

As another method, not only the LF roller but also the discharge roller comprise encoders to control conveyance. However, neither a concrete control method nor an arrangement when controlling conveyance using two encoders has been established.

SUMMARY OF THE INVENTION

The present invention is directed to a conveyance apparatus, control method, and printing apparatus.

According to one aspect of the present invention, preferably, there is provided a conveyance apparatus which has a first conveyance roller and a second conveyance roller on a downstream side of the first conveyance roller in a conveyance direction, and conveys a sheet, comprising: a DC motor serving as a driving source for the first conveyance roller and the second conveyance roller; a first encoder which outputs a first pulse signal in accordance with rotation of the first conveyance roller; a second encoder which outputs a second pulse signal in accordance with rotation of the second conveyance roller; and a control unit having a first mode in which the DC motor is controlled on the basis of first information about the first pulse signal when executing a conveyance operation to convey the sheet by using the first conveyance roller and the second conveyance roller, and a second mode in which the DC motor is controlled on the basis of second information about the second pulse signal when executing a conveyance operation to convey the sheet by using the second conveyance roller, the control unit adjusting the second information on the basis of a relationship between a period of the first pulse signal and a period of the second pulse signal before executing the second mode.

According to another aspect of the present invention, preferably, there is provided a control method for a conveyance apparatus which has a first conveyance roller, a second conveyance roller on a downstream side of the first conveyance roller in a conveyance direction, a DC motor serving as a driving source for the first conveyance roller and the second conveyance roller, a first encoder that outputs a first pulse signal in accordance with rotation of the first conveyance roller, and a second encoder that outputs a second pulse signal in accordance with rotation of the second conveyance roller, the conveyance apparatus conveying a sheet, the method comprising: a first control step of controlling the DC motor on the basis of first information about the first pulse signal when executing a conveyance operation to convey the sheet by using the first conveyance roller and the second conveyance roller; an adjustment step of adjusting second information about the second pulse signal on the basis of a relationship between a period of the first pulse signal and a period of the second pulse signal after control in the first control step; and a second control step of controlling the DC motor on the basis of the second information when executing a conveyance operation to convey the sheet by using the second conveyance roller.

According to still another aspect of the present invention, preferably, there is provided a printing apparatus which has a first conveyance roller and a second conveyance roller on a downstream side of the first conveyance roller in a conveyance direction, and prints on a conveyed print medium, comprising: a DC motor serving as a driving source for the first conveyance roller and the second conveyance roller; a first encoder which outputs a first pulse signal in accordance with rotation of the first conveyance roller; a second encoder which outputs a second pulse signal in accordance with rotation of the second conveyance roller; and a control unit having a first mode in which the DC motor is controlled on the basis of first information about the first pulse signal when executing a conveyance operation to convey the sheet by using the first conveyance roller and the second conveyance roller, and a second mode in which the DC motor is controlled on the basis of second information about the second pulse signal when executing a conveyance operation to convey the sheet by using the second conveyance roller, the control unit adjusting the second information on the basis of a relationship between a period of the first pulse signal and a period of the second pulse signal before executing the second mode.

The invention is particularly advantageous since conveyance control using an LF encoder and discharge encoder can be implemented, and the conveyance precision of print paper can be increased. The invention is also advantageous since conveyance control using the discharge encoder can be implemented, and the conveyance precision of a conveyance operation when printing at the trailing end of a sheet can be increased.

According to still another aspect of the present invention, preferably, there is provided a conveyance apparatus which has a first conveyance roller and a second conveyance roller on a downstream side of the first conveyance roller in a conveyance direction, and conveys a sheet, comprising: a DC motor serving as a driving source for the first conveyance roller and the second conveyance roller; a first encoder which outputs a first pulse signal in accordance with rotation of the first conveyance roller; a second encoder which outputs a second pulse signal in accordance with rotation of the second conveyance roller; and a control unit having a first mode in which the DC motor is controlled on the basis of first information about the first pulse signal when executing a conveyance operation to convey the sheet by using the first conveyance roller and the second conveyance roller, and a second mode in which the DC motor is controlled on the basis of second information about the second pulse signal when executing a conveyance operation to convey the sheet by using the second conveyance roller, the control unit adjusting the second information on the basis of a relationship between a phase difference the first pulse signal between the second pulse signal before executing the second mode.

According to still another aspect of the present invention, preferably, there is provided a printing apparatus which has a first conveyance roller and a second conveyance roller on a downstream side of the first conveyance roller in a conveyance direction, and prints on a conveyed print medium, comprising: a DC motor serving as a driving source for the first conveyance roller and the second conveyance roller; a first encoder which outputs a first pulse signal in accordance with rotation of the first conveyance roller; a second encoder which outputs a second pulse signal in accordance with rotation of the second conveyance roller; and a control unit having a first mode in which the DC motor is controlled on the basis of first information about the first pulse signal when executing a conveyance operation to convey the sheet by using the first conveyance roller and the second conveyance roller, and a second mode in which the DC motor is controlled on the basis of second information about the second pulse signal when executing a conveyance operation to convey the sheet by using the second conveyance roller, the control unit adjusting the second information on the basis of a relationship between a phase difference the first pulse signal between the second pulse signal before executing the second mode.

Further features of the present invention will become apparent from the following description of exemplary embodiments (with reference to the attached drawings).

DESCRIPTION OF THE EMBODIMENTS

Exemplary embodiments according to the present invention will be described in detail below with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Figure 1:
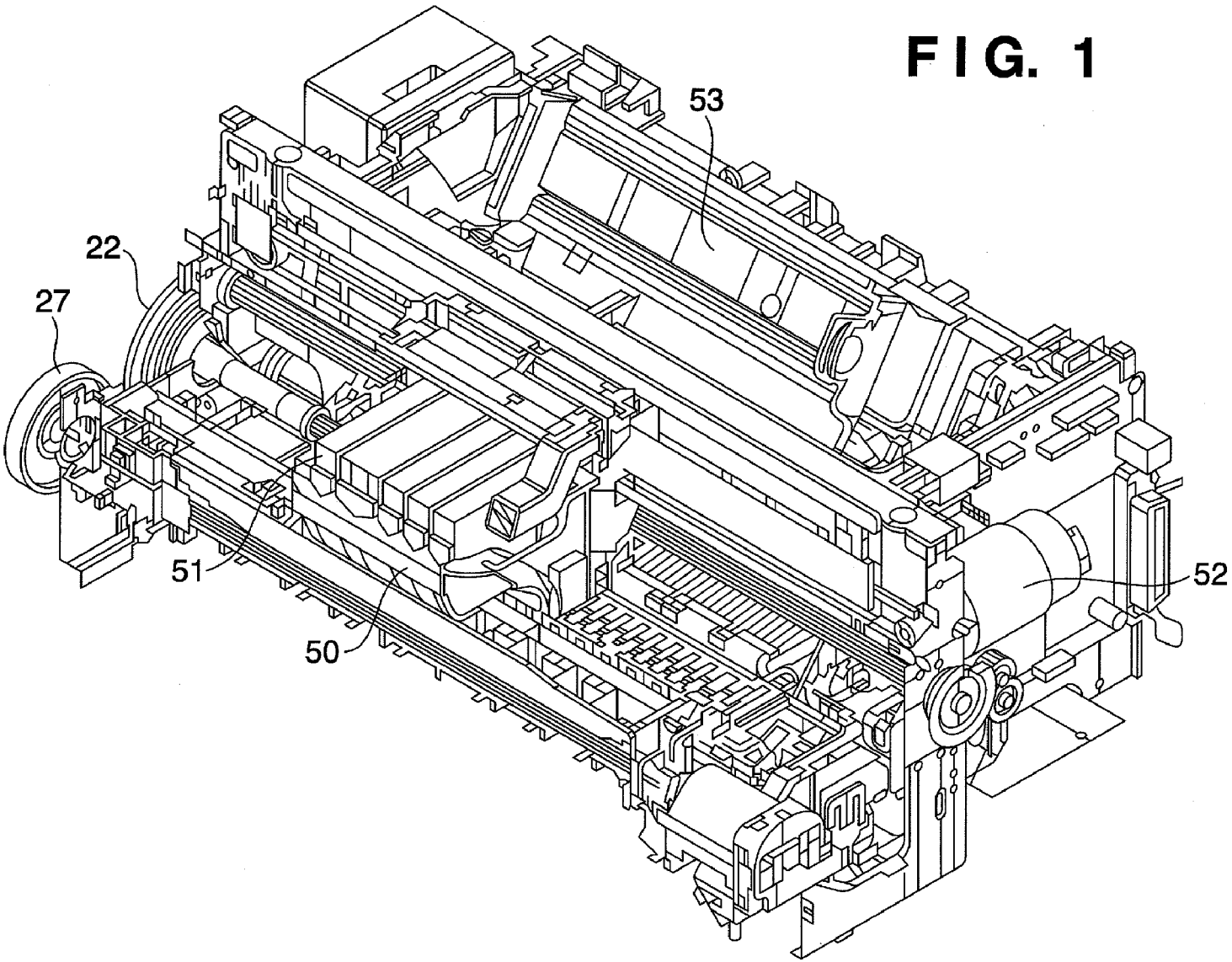
FIG. 1 is a perspective view of a printing apparatus according to an exemplary embodiment.

FIG. 1 is a perspective view of a printing apparatus which prints on print paper (print medium) while a printhead 51 moves in the main scanning direction. A carriage 50 supports the printhead 51. A carriage motor 52 serves as a driving source for scanning the carriage 50. A print medium on a stacking unit 53 is fed by a feed roller (not shown). The printing apparatus comprises a conveyance mechanism to convey the print medium in the sub-scanning direction. Reference numeral 22 denotes an LF code wheel; and 27, a discharge code wheel. The conveyance mechanism including the LF code wheel 22 and discharge code wheel 27 will be described later. The printing apparatus forms an image on a print medium by repeating conveyance of the print medium by a predetermined amount and scanning of the carriage supporting the printhead.

Figure 2:
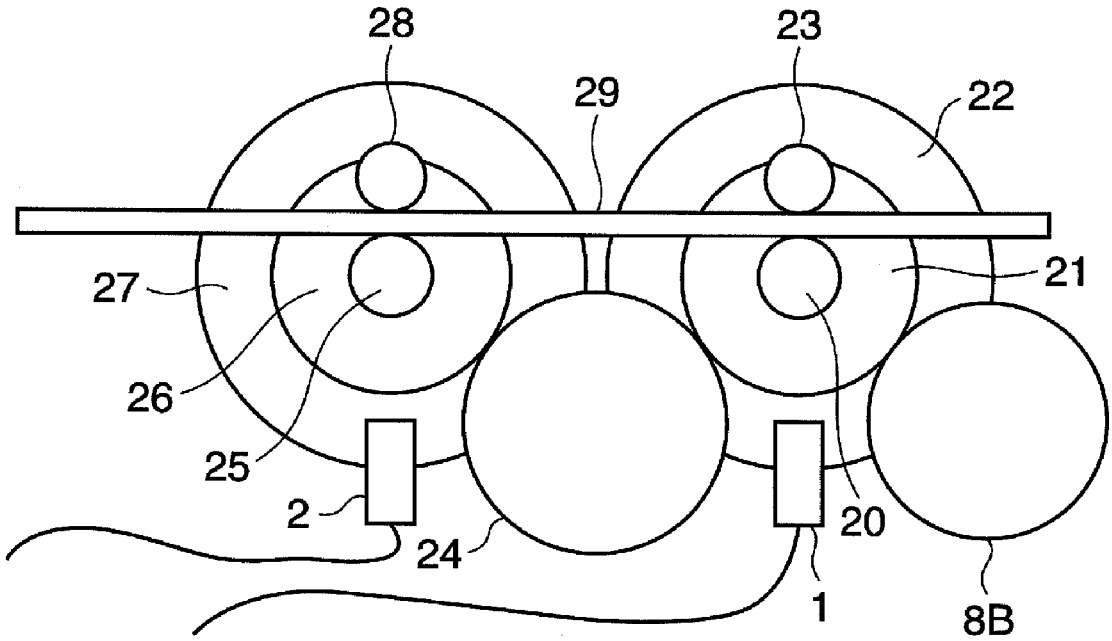
FIG. 2 is a sectional view of a conveyance apparatus.

FIG. 2 is a sectional view of the conveyance mechanism. Reference numeral 1 denotes a conveyance encoder (LF encoder); and 2, a discharge encoder (EJ encoder). A CPU which controls the printing apparatus based on signals from the encoders executes servo control to drive a DC motor serving as a driving source, which will be described later.

In FIG. 2, the left side is the downstream side in the conveyance direction, and the right side is the upstream side in the conveyance direction.

Reference numeral 20 denotes an LF roller (conveyance roller); 21, an LF gear; 22, the LF code wheel; and 23, a pinch roller. Reference numeral 25 denotes a discharge roller; 26, a discharge gear; 27, the discharge code wheel; 28, a spur; and 29, a print paper. Reference numeral 24 denotes a driving transfer gear which transfers the driving forces of the LF gear 21 and discharge gear 26. It should be noted that the feed roller conveys a print medium on the stacking unit (tray) up to the LF roller.

In FIG. 2, an LF motor 8B is in contact with the LF gear 21. A gear attached to the driving shaft of the LF motor 8B meshes with the LF gear 21. As the LF motor 8B rotates, the LF gear 21 also rotates interlockingly.

The LF gear 21 rotates to rotate the LF roller 20 and the LF code wheel 22 attached to the LF roller 20.

The discharge gear 26 also rotates via the driving transfer gear 24 meshed with the LF gear 21. In this structure, the discharge roller 25 also rotates, and as a result the discharge code wheel 27 also rotates.

During conveyance, the print paper 29 is supported at two points: a point between the LF roller 20 and the pinch roller 23, and a point between the discharge roller 25 and the spur 28. When printing at the trailing end of the print paper 29, the print paper 29 is conveyed only by the discharge roller 25 and spur 28 because it has passed through the support by the LF roller 20 and pinch roller 23.

Figure 4:
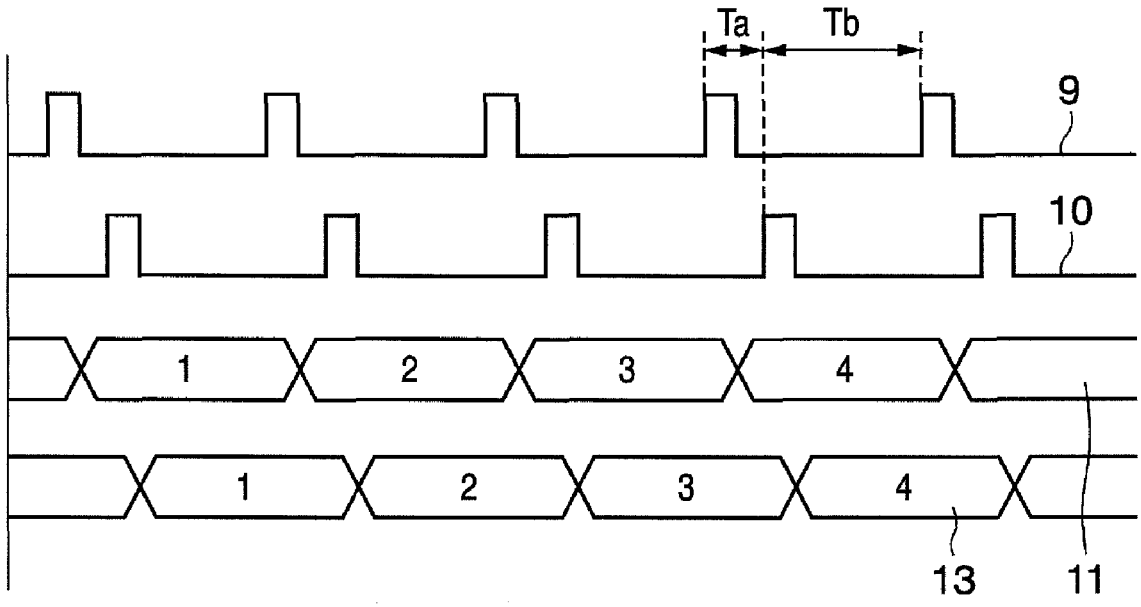
FIG. 4 is a timing chart for explaining the timing of an encoder signal.

FIG. 4 is a timing chart for explaining the phase relationship between signals from the two encoders (LF and discharge encoders). In FIG. 4, time elapses from left to right. Reference numeral 9 denotes an LF encoder signal; and 10, a discharge encoder signal. Ta represents the time interval from an LF encoder pulse to a discharge encoder pulse. Tb represents the time interval from a discharge encoder pulse to an LF encoder pulse. In FIG. 4, Ta<Tb.

Figure 5:
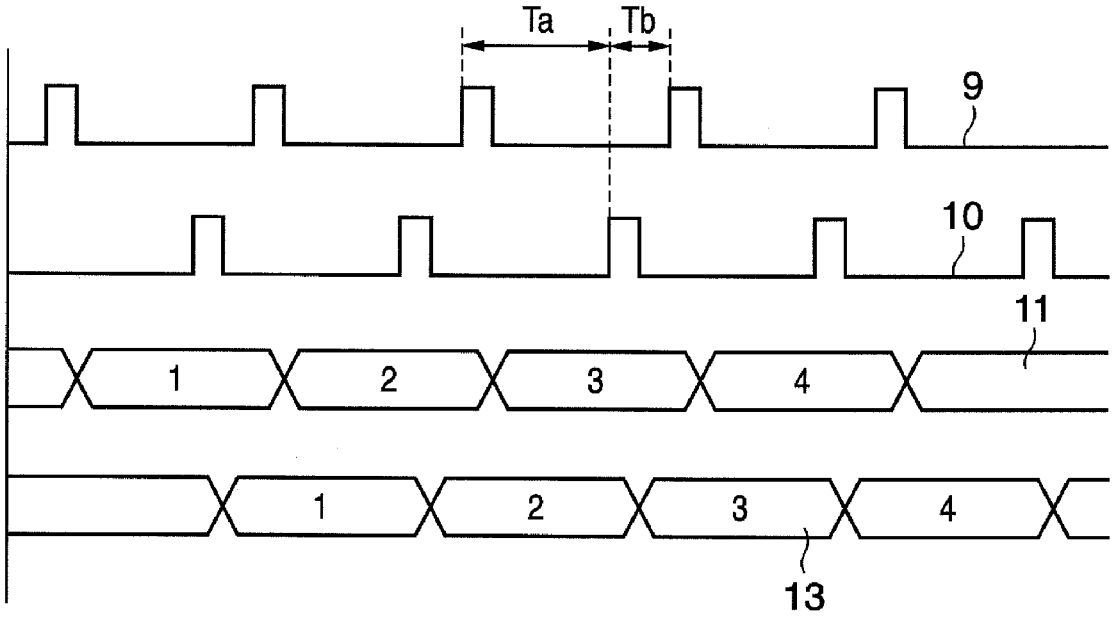
FIG. 5 is a timing chart for explaining the timing of the encoder signal.

FIG. 5 is a timing chart for explaining the phase relationship between signals from the two encoders (LF and discharge encoders), similar to FIG. 4. Ta and Tb satisfy Ta>Tb.

In FIGS. 4 and 5, reference numeral 11 denotes LF position information which is the count value of the LF encoder. In FIGS. 4 and 5, reference numeral 13 denotes EJ position information which is the count value of the discharge encoder.

First Embodiment

Figure 3:
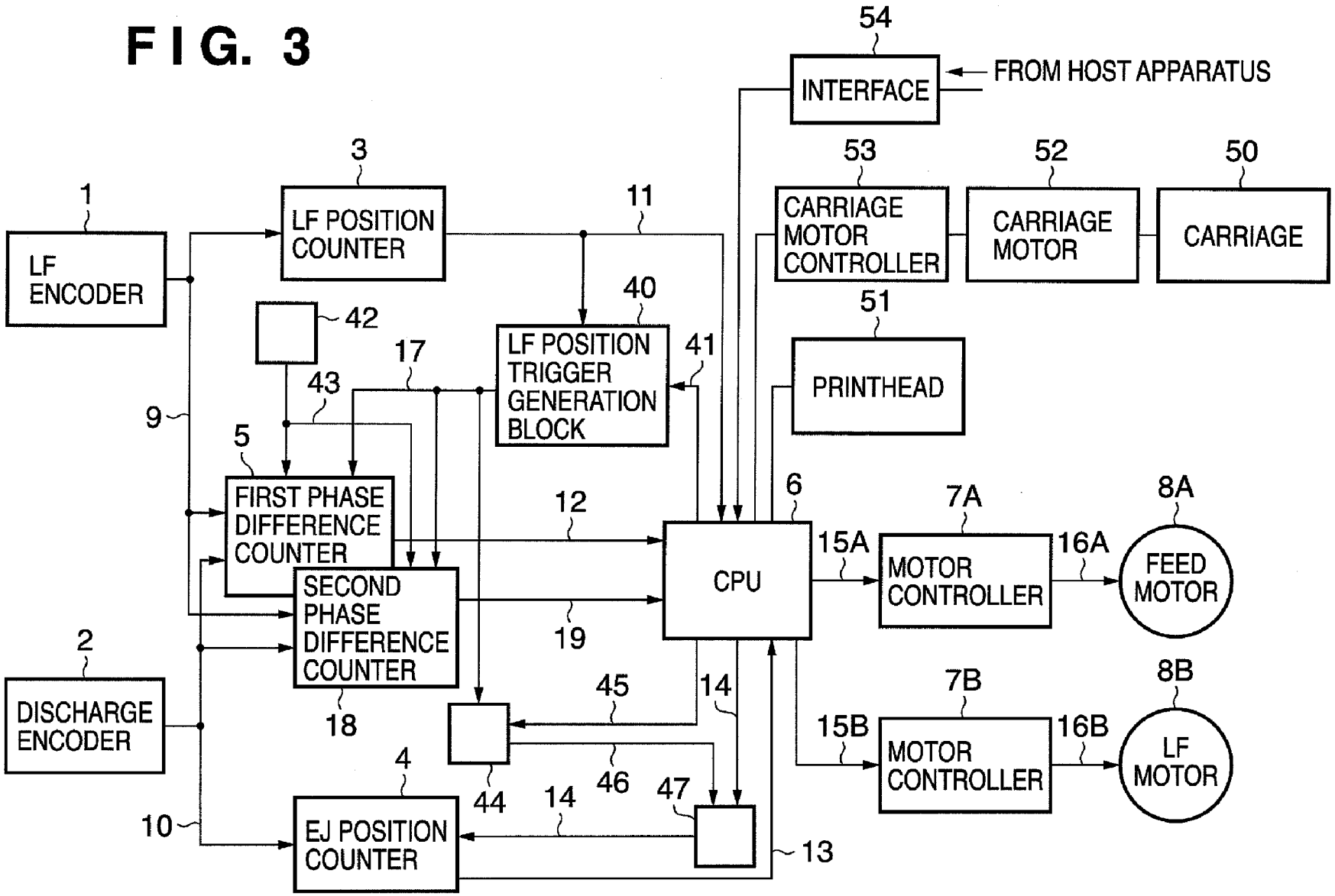
FIG. 3 is a block diagram of control blocks according to the first embodiment.

FIG. 3 is a block diagram for controlling the conveyance mechanism of a printing apparatus. Reference numeral 3 denotes a position counter (LF position counter) for an LF encoder. The LF position counter 3 counts position information of the LF encoder upon receiving an LF encoder signal 9 output from an LF encoder 1.

Reference numeral 4 denotes a position counter (EJ position counter) for a discharge encoder. The EJ position counter 4 counts position information of the discharge encoder upon receiving a discharge encoder signal 10 output from a discharge encoder 2.

When an LF trigger 46 is input to a rewrite register 47, a value held by the rewrite register 47 can be written in the EJ position counter 4. A CPU 6 sets LF sync position information 14 which is a value held by the rewrite register 47.

Reference numeral 44 denotes a mask circuit which masks the LF trigger. By enabling the mask circuit 44, neither the LF trigger 46 is output, nor is the value of the EJ position counter 4 rewritten. To the contrary, by disabling the mask circuit 44, the value of the EJ position counter 4 becomes rewritable. A signal 45 output from the CPU 6 enables or disables the mask circuit 44.

Reference numeral 40 denotes an LF trigger generation block (LF position trigger generation block). The LF trigger generation block 40 compares the value of trigger output setting information 41 set by the CPU 6 with the value of LF encoder position information (LF position information) 11. If these values coincide with each other, the LF trigger generation block 40 outputs an LF trigger signal 17.

Reference numeral 5 denotes a first phase difference counter. Upon receiving the LF trigger signal 17, the first phase difference counter 5 refers to the LF encoder signal 9 and discharge encoder signal 10, and counts their phase difference. At this time, the first phase difference counter 5 counts the phase difference using a clock signal 43 output from a count clock generation unit (clock generation unit) 42.

Note that the LF trigger signal 17 is used to count the phase difference between the encoder signals 9 and 10, and to rewrite EJ position information (to be described later). The control blocks shown in FIG. 3 are so arranged as to output the LF trigger signal 17 in accordance with the application purpose.

Similarly, reference numeral 18 denotes a second phase difference counter. Upon receiving the LF trigger signal 17, the second phase difference counter 18 refers to the LF encoder signal 9 and discharge encoder signal 10, and counts their phase difference.

The CPU 6 independently reads out LF position information 11 from the LF position counter 3, and discharge position information (EJ position information) 13 from the EJ position counter 4. The CPU 6 servo-controls a feed motor 8A by outputting to a motor controller 7A a control signal 15A for controlling the feed motor 8A. Reference numeral 16A denotes a signal output from the motor controller 7A to the feed motor 8A in servo control.

The CPU 6 servo-controls an LF motor 8B by outputting to a motor controller 7B a control signal 15B for controlling the LF motor 8B. Reference numeral 16B denotes a signal output from the motor controller 7B to the LF motor 8B in servo control.

The servo control includes position servo control to perform control based on position information, and velocity servo control to perform control based on velocity information. The DC motor is controlled by a combination of position servo control and velocity servo control. For descriptive convenience, the first embodiment considers only position servo control.

Reference numeral 51 denotes a printhead which is mounted on a carriage 50. A carriage motor 52 drives the carriage 50 under the control of a carriage motor controller 53.

Reference numeral 54 denotes an interface connected to an external host apparatus.

As an example of mounting the control blocks shown in FIG. 3, a single ASIC includes a circuit unit except for the LF encoder 1, discharge encoder 2, motor controller 7A, motor controller 7B, feed motor 8A, LF motor 8B, carriage 50, printhead 51, carriage motor 52, carriage motor controller 53, and interface 54.

Figure 6:
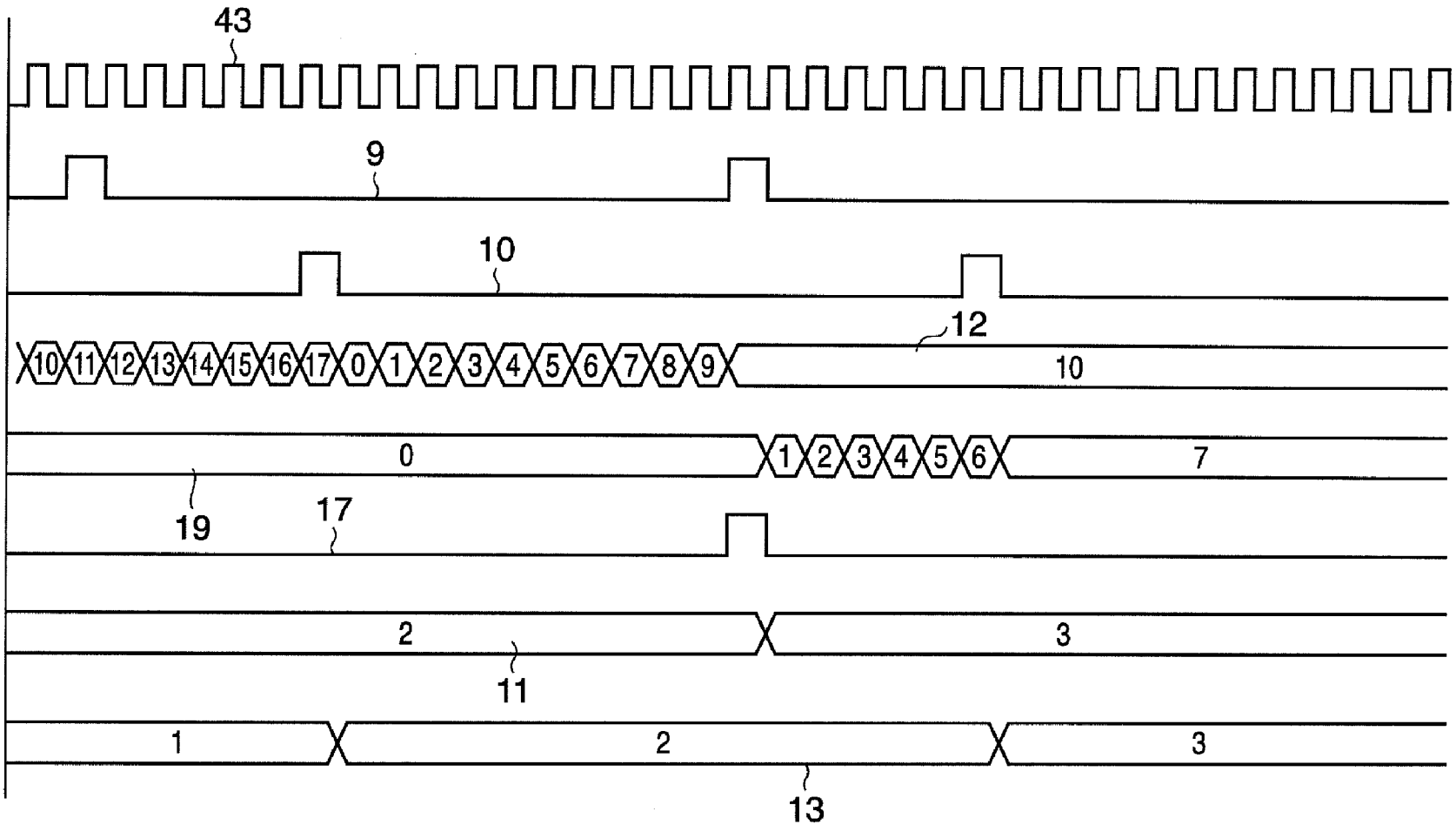
FIG. 6 is a timing chart for explaining an encoder information process.

In FIG. 6, reference numeral 12 denotes first phase difference information; and 19, second phase difference information. The CPU 6 determines the value of the LF sync position information 14 in accordance with the contents of the first phase difference information 12 and second phase difference information 19. The first phase difference information 12 corresponds to Tb in FIGS. 4 and 5, and the second phase difference information 19 corresponds to Ta in FIGS. 4 and 5.

FIG. 6 is a timing chart showing the operations of the first phase difference counter 5 and second phase difference counter 18. The phase difference when the value of the LF position information 11 is "3" is measured.

As represented by the first phase difference information 12, the first phase difference counter 5 counts the time between an LF encoder pulse and a preceding discharge encoder pulse. As represented by the second phase difference information 19, the second phase difference counter 18 counts the time between an LF encoder pulse and a succeeding discharge encoder pulse.

Counting is done based on the clock signal 43, and for example the counter value is counted up every leading edge.

Every time the pulse of the discharge encoder signal 10 is input, the values of the two counters are cleared to 0. The first phase difference information 12 is held based on input of the LF trigger signal 17.

The second phase difference counter 18 starts counting at the timing when the LF trigger signal 17 is input, and fixes the counter value at the timing when the first pulse of the discharge encoder signal 10 is input.

Figure 7:
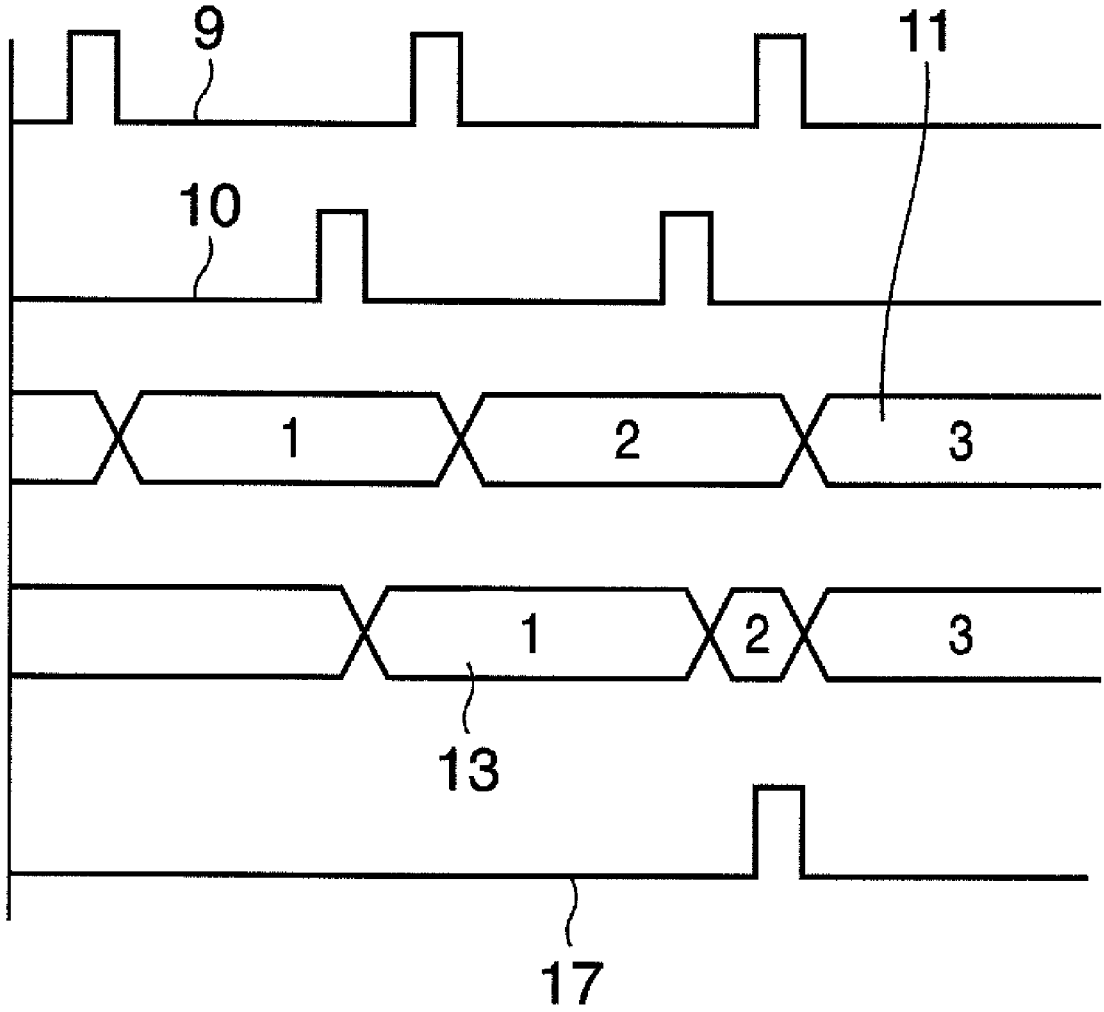
FIG. 7 is a timing chart for explaining the encoder information process.

FIG. 7 is a timing chart for explaining a process to equalize the values of the EJ position information 13 and LF position information 11 with each other.

FIG. 7 shows a process executed when Ta>Tb as shown in FIG. 5. A case where the value of the EJ position information 13 is rewritten at the timing of the third pulse of the LF encoder signal 9 after the start of the conveyance operation will be explained. At the timing when the LF position information 11 changes to "3", the LF trigger signal 17 is output, and the LF trigger 46 is input to the rewrite register 47 via the mask circuit 44. In other words, the output timing of the LF trigger signal 17 synchronizes with the pulse output of the LF encoder signal 9. As a result, the value "3" held by the rewrite register 47 is set in the EJ position counter 4. By setting "3" in the EJ position counter 4, the EJ position information 13 is updated.

The rewrite register 47 holds the value "3" before the start of the conveyance operation. By using the rewrite register, a value corresponding to the amount of conveyance of a conveyance operation to be executed next can be set before executing the conveyance operation.

This process can equalize the LF position information and EJ position information even when the EJ position information is updated with a large delay, as shown in FIG. 5. In contrast, for Ta<Tb, the value of the EJ position counter 4 is kept at "2" without performing any rewrite process, or "2" is set in the EJ position counter 4.

The phase relationship (Ta>Tb or Ta<Tb) between pulses from these encoders suffices to be measured in advance in a preceding conveyance operation.

The arrangement to update EJ position information to a desired value is effective when the resolutions of the LF encoder and discharge encoder are different.

<Sequence to Measure Phase Difference and Change Position Information>

Figure 8:
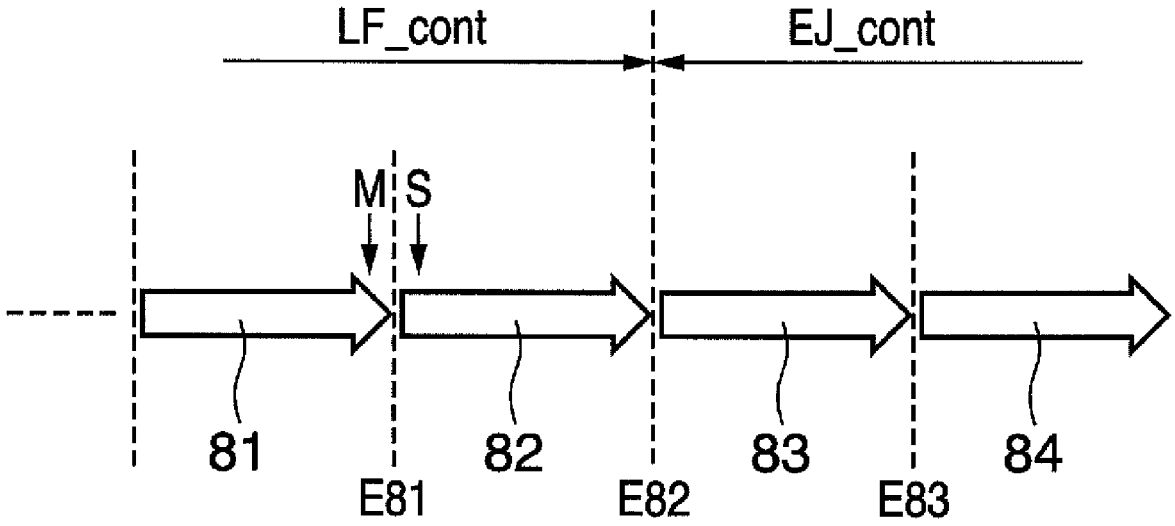
FIG. 8 is an explanatory view of the conveyance operation.

A sequence to measure the phase difference between encoder signals (pulses) and change position information will be explained. For descriptive convenience, FIG. 8 shows four conveyance operations 81, 82, 83, and 84 extracted from conveyance operations executed during the printing operation. FIG. 8 shows that servo control based on an LF encoder signal is executed in the conveyance operations 81 and 82, and servo control based on a discharge encoder signal is executed in the conveyance operations 83 and 84.

Note that, after the trailing end of paper passes through the LF roller (nip of the LF roller) by the conveyance operation, the discharge roller conveys the paper. That is, after the trailing end of paper passes through the LF roller (nip of the LF roller), conveyance operation control switches from servo control based on an LF encoder signal to that based on a discharge encoder signal. Control switches between the conveyance operation 82 and the conveyance operation 83.

Thus, the value of the EJ position information 13 is rewritten before executing the conveyance operation 83. For this purpose, the phase relationship between pulses from the encoders is checked in the conveyance operation 81. The check is executed at end timing M of the conveyance operation 81. The EJ position information 13 is rewritten at operation start timing S of the conveyance operation 82.

Note that rewrite of the EJ position information 13 in the conveyance operation 82 does not affect control of the conveyance operation 82 because the LF position information 11 used for the control does not change.

<Control Sequence>

Figure 10:
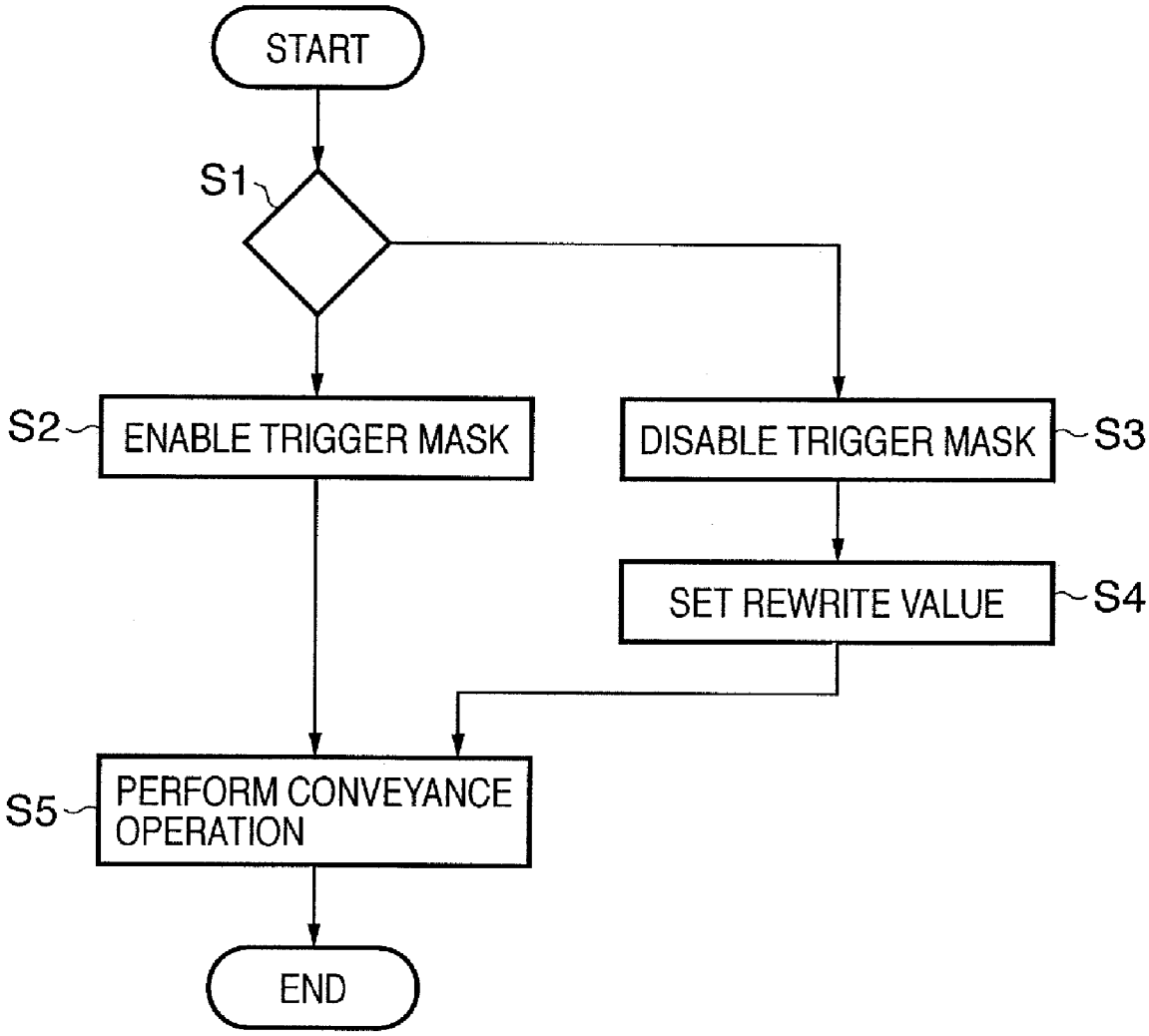
FIG. 10 is a flowchart of a control sequence according to the first embodiment.

A control sequence associated with the conveyance operation will be explained with reference to FIG. 10. This sequence is executed every conveyance operation. In S1, it is determined whether the current conveyance operation is a conveyance operation to rewrite the EJ position information 13. In FIG. 8, the conveyance operation 82 is a conveyance operation to rewrite the EJ position information 13.

This determination is based on the number of conveyance operations in a 1-page printing operation, the number of cumulative pulses in the conveyance operations in the 1-page printing operation, and the like.

In this manner, it is determined whether to execute rewrite in a conveyance operation to be executed.

If the EJ position information 13 is to be rewritten, the process advances to S3 to disable the trigger mask. If no EJ position information 13 is to be rewritten, the process advances to S2 to enable the trigger mask. If the EJ position information 13 is to be executed, a rewrite value is set in S4. In S5, the conveyance operation is performed.

The rewrite value in S4 is determined based on the phase relationship (Ta>Tb or Ta<Tb) between pulses from the encoders, as described above.

According to the above-described control sequence, when executing rewrite, the LF trigger 46 is output during the conveyance operation, as shown in FIG. 7. The EJ position information 13 can be rewritten into a rewrite value set in advance as the LF sync position information 14.

If no rewrite is to be executed, the trigger mask is enabled to neither output an LF trigger signal during the conveyance operation nor rewrite the EJ position information 13. For example, no rewrite process is done in the conveyance operations 81, 83, and 84 in FIG. 8.

This rewrite process allows switching the conveyance operation from servo control based on an LF encoder signal to servo control based on a discharge encoder signal even if pulses from the encoders have a phase difference.

Even when a conveyance operation by the LF roller and discharge roller shifts to one by the discharge roller, the above-described control sequence can reliably achieve conveyance control and implement conveyance by a desired amount of conveyance. This control sequence can reduce conveyance pitch nonuniformity in printing.

Second Embodiment

Another sequence to measure the phase difference and change position information will be explained with reference to FIG. 9.

Figure 9:
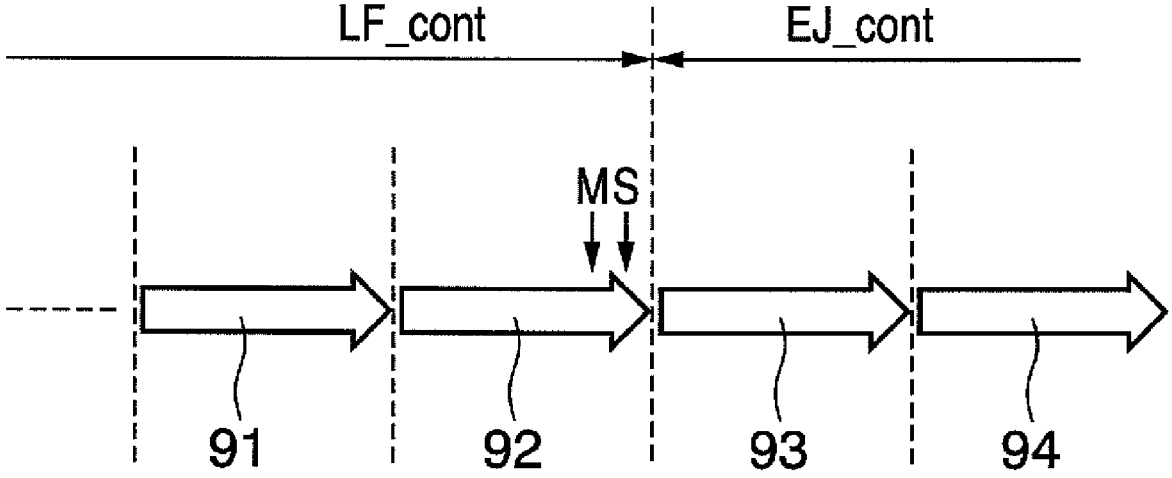
FIG. 9 is an explanatory view of the conveyance operation.

For descriptive convenience, similar to FIG. 8, FIG. 9 shows four conveyance operations 91, 92, 93, and 94 extracted from conveyance operations executed during the printing operation. Similar to FIG. 8, FIG. 9 shows that servo control based on an LF encoder signal is executed in the conveyance operations 91 and 92, and servo control based on a discharge encoder signal is executed in the conveyance operations 93 and 94.

FIG. 9 is different from FIG. 8 in that timing M when the phase relationship between pulses from encoders is checked and timing S when EJ position information 13 is rewritten fall within the same conveyance operation. That is, as shown in FIG. 9, timing M when the phase relationship is checked and timing S when the EJ position information 13 is rewritten exist in the conveyance operation 92.

The phase relationship can be more accurately determined by checking the phase relationship between pulses from the encoders at the timing closest to the servo control period EJ_cont based on a discharge encoder signal.

Third Embodiment

Another embodiment using a different control sequence associated with the conveyance operation will be described with reference to FIG. 11. Similar to the sequence in FIG. 10, this sequence is executed every conveyance operation. The sequence in FIG. 11 is different from that in FIG. 10 in that EJ position information 13 is rewritten after executing the conveyance operation, that is, the control unit (e.g., CPU) determines that the conveyance operation stops.

Figure 11:
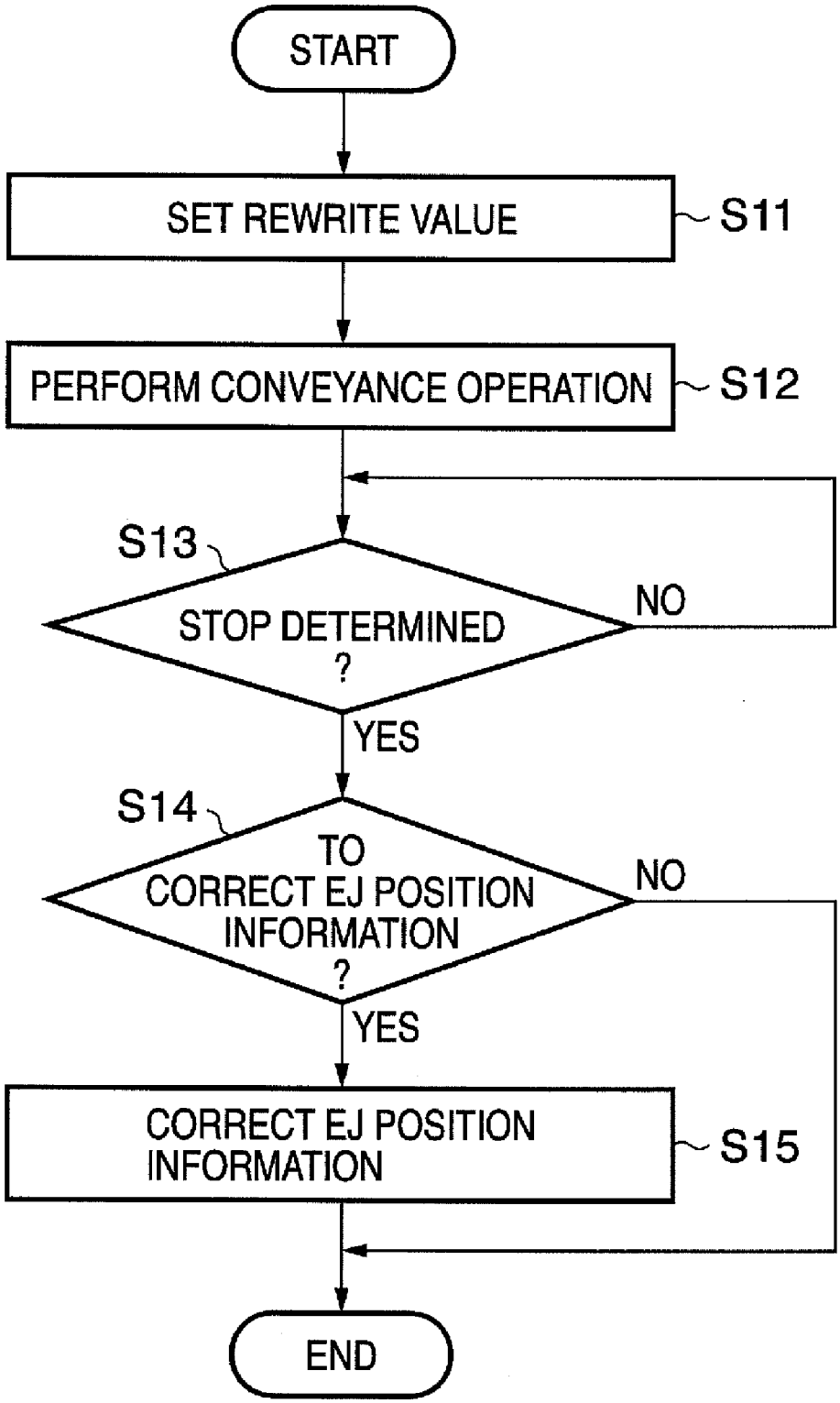
FIG. 11 is a flowchart of a control sequence according to the third embodiment.

The sequence in FIG. 11 is premised on that the phase relationship between pulses from encoders satisfies Ta>Tb and the rewrite process is performed every conveyance operation.

The EJ position information 13 is corrected when the phase relationship is Ta<Tb after performing the conveyance operation.

A rewrite value is set in S11, and the conveyance operation is done in S12. The process waits until it is determined in S13 that the conveyance operation stops. In S14, it is determined based on the phase difference whether to correct the EJ position information 13. If it is determined in S14 that the EJ position information 13 must be corrected, the EJ position information 13 is corrected in S15.

If Ta<Tb, it is determined in S14 that the EJ position information 13 must be corrected, and the process advances to S15 in order to execute correction. If Ta>Tb, it is determined in S14 that the EJ position information 13 need not be corrected, and the process ends.

Figure 12:
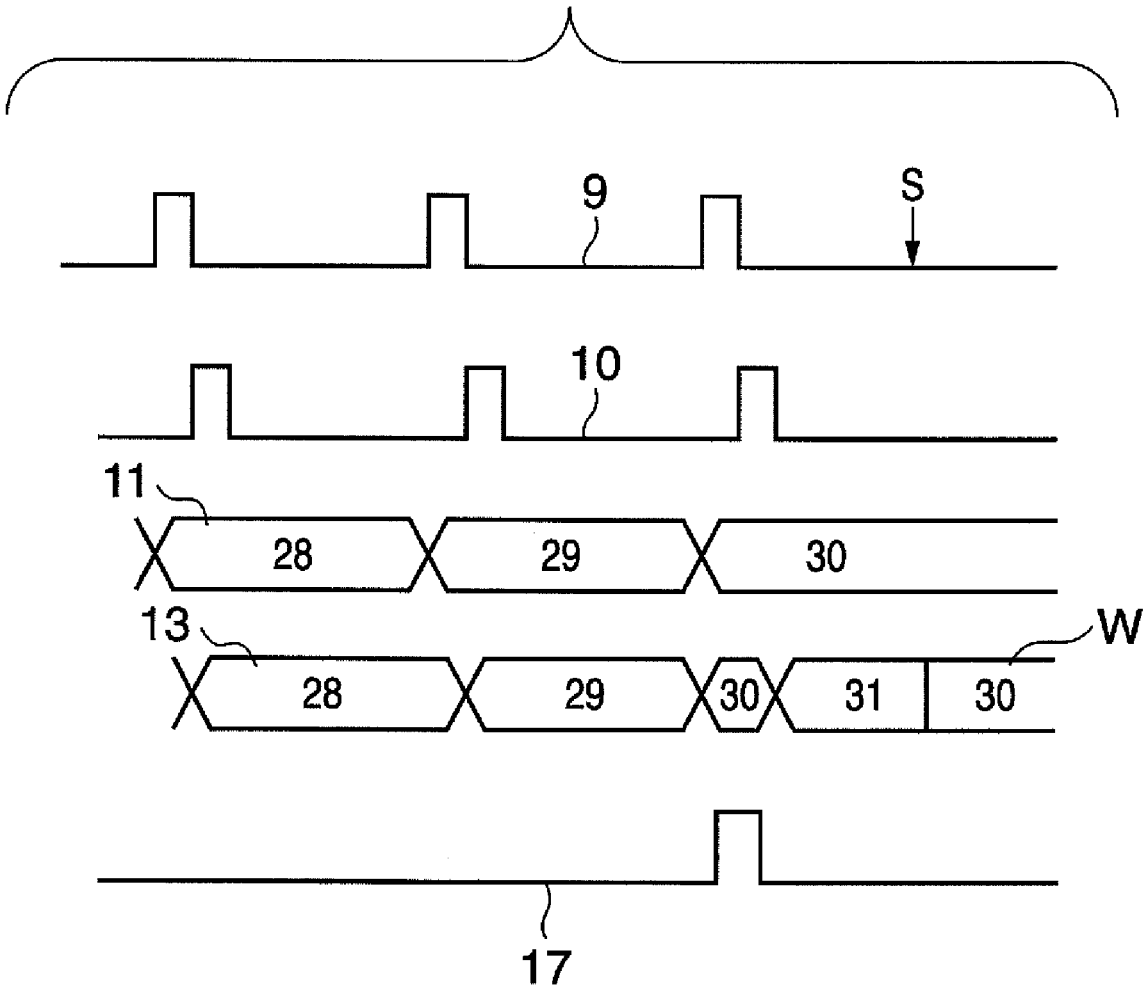
FIG. 12 is a timing chart for explaining an encoder information process.

FIG. 12 is a timing chart when Ta<Tb. As is apparent from FIG. 12, the value of the EJ position information 13 becomes different from that of LF position information 11 as a result of the rewrite process. Thus, after it is determined at timing S that the conveyance operation stops, a CPU 6 rewrites the value of the EJ position information 13 from "31" to "30" at timing W.

Fourth Embodiment

The first embodiment has described the arrangement to control the conveyance mechanism with reference to FIG. 3. The fourth embodiment will explain another arrangement with reference to FIG. 13.

Figure 13:
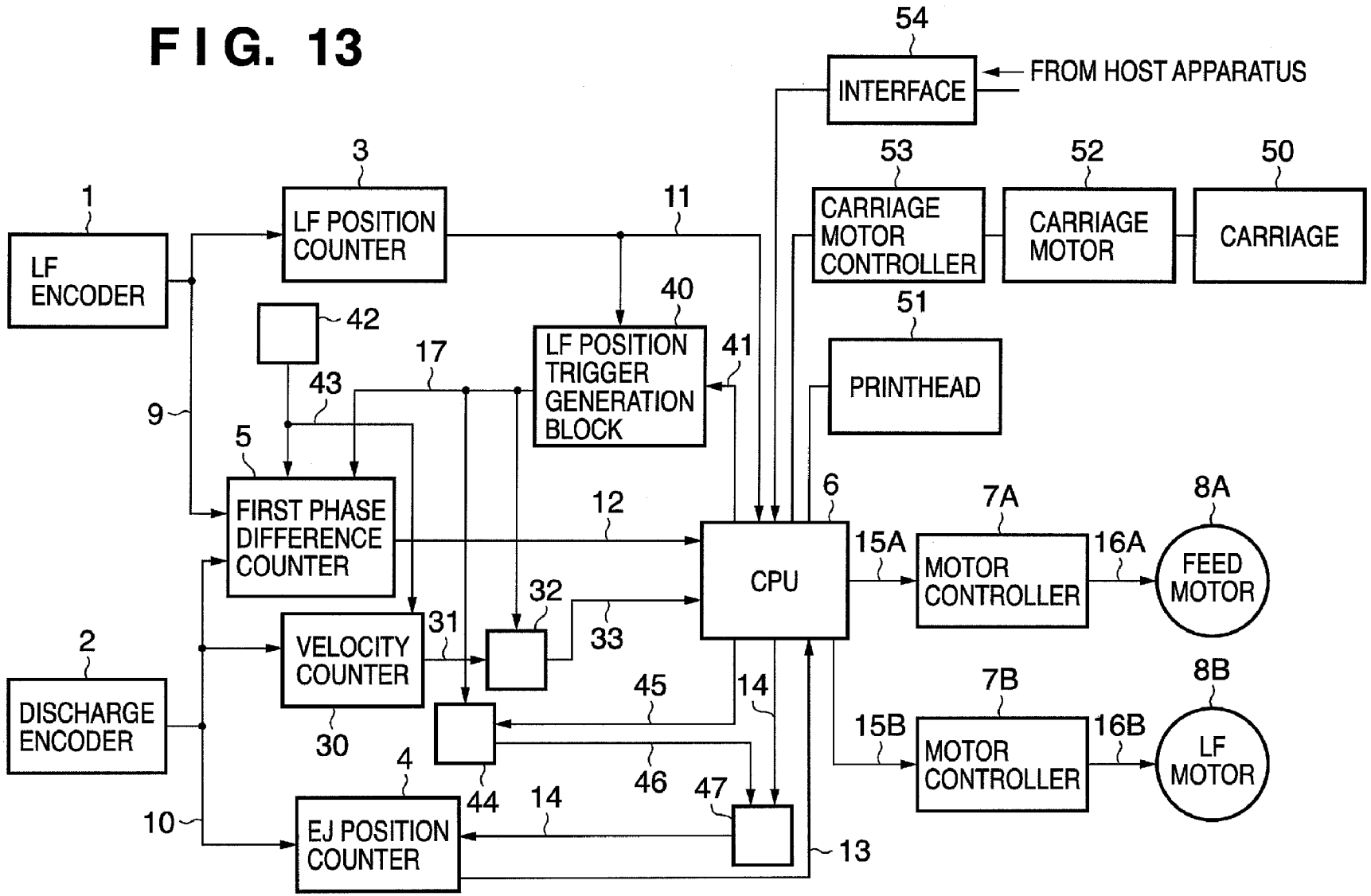
FIG. 13 is a block diagram of control blocks according to the fourth embodiment.

In FIG. 13, reference numerals 1 to 17, 40 to 46, 50 to 54 are the same as those in FIG. 3, and a description thereof will not be repeated. As a difference from FIG. 3, reference numeral 30 denotes a velocity counter which measures the pulse interval of a discharge encoder signal 10 by using a clock signal 43.

Reference numeral 31 denotes velocity information which is the count value of the pulse interval of a discharge encoder. Reference numeral 32 denotes a fixing block which receives the velocity information 31 and an LF trigger signal 17, and fixes the count value of the pulse interval of the discharge encoder. The fixing block 32 outputs a fixed count value 33 of the pulse interval of the discharge encoder to a CPU 6.

Figure 14:
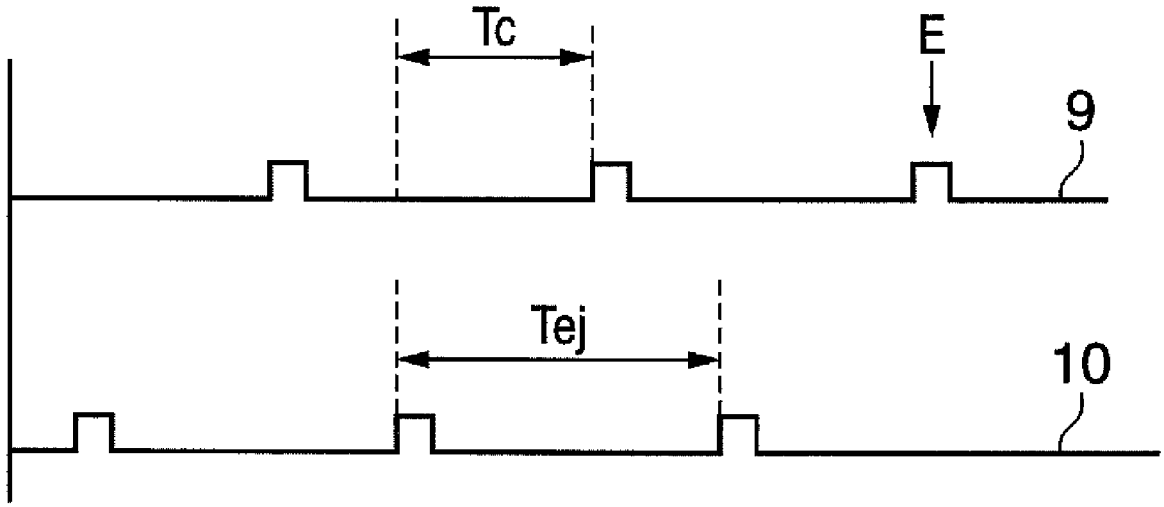
FIG. 14 is a timing chart for explaining an encoder signal process according to the fourth embodiment.

Referring to FIG. 14, the velocity counter 30 counts the period (time) Tej between a given pulse and preceding pulse of the discharge encoder signal 10. A first phase difference counter 5 counts the period Tc between the pulse of the discharge encoder signal 10 and the pulse of an LF encoder signal 9.

The above-mentioned phase relationship (Ta<Tb or Ta>Tb) between encoder signals may be determined from these two counter values.

According to the fourth embodiment, even when it is not guaranteed that the pulse of the discharge encoder signal 10 is always generated after outputting pulse E of the LF encoder signal 9, the pulse period of the discharge encoder can be reliably measured. In this case, the fourth embodiment is premised on that the length of the pulse period of the discharge encoder does not greatly change.

The fourth embodiment may be combined with the second or third embodiment.

Other Embodiments

The conveyance apparatus has been described above, and its application is not limited to a printing apparatus. For example, the conveyance apparatus is also applicable to a scanner or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-226700, filed Aug. 23, 2006, which is hereby incorporated by reference herein in its entirety.

What is claimed is:

1. A conveyance apparatus which has a first conveyance roller and a second conveyance roller on a downstream side of the first conveyance roller in a conveyance direction, and conveys a sheet, comprising:

a DC motor serving as a driving source for the first conveyance roller and the second conveyance roller;

a first encoder which outputs a first pulse signal in accordance with rotation of the first conveyance roller;

a second encoder which outputs a second pulse signal in accordance with rotation of the second conveyance roller;

a first counter which counts the number of pulses of the first pulse signal outputted from the first encoder;

a second counter which counts the number of pulses of the second pulse signal outputted from the second encoder;

an obtain unit which obtains a phase difference between the first pulse signal and the second pulse signal;

a control unit having a first mode in which said DC motor is controlled based on a value counted by the first counter when executing a conveyance operation to convey the sheet by using the first conveyance roller and the second conveyance roller, and a second mode in which said DC motor is controlled based on a value counted by the second counter when executing a conveyance operation to convey the sheet by using the second conveyance roller, wherein the control unit adjusts the value counted by the second counter using the value counted by the first counter based on the phase difference obtained by the obtain unit before executing the second mode.

2. A conveyance apparatus according to claim 1, wherein the control unit adjusts the value counted by the second counter using the value counted by the first counter, when the phase difference obtained by the obtain unit is more than a half of a cycle of the first pulse signal.

3. A conveyance apparatus according to claim 2, wherein the control unit adjusts the value counted by the second counter using the value counted by the first counter, when a value counted by the first counter becomes a predetermined value.

4. A conveyance apparatus according to claim 1, wherein the obtain unit obtains the phase difference in one conveyance operation in the first mode.

5. A printing apparatus including the conveyance apparatus according to claim 1.

* * * * *